US009296558B2

(12) United States Patent
Parker

(10) Patent No.: US 9,296,558 B2
(45) Date of Patent: Mar. 29, 2016

(54) VERTICAL ADJUSTABLE SIDE ARM OF A REFUSE VEHICLE

(71) Applicant: The Curotto-Can, LLC, Chattanooga, TN (US)

(72) Inventor: Brian T. Parker, Signal Mountain, TN (US)

(73) Assignee: The Curotto-Can, LLC, Chattanooga, TN (US)

( * ) Notice: Subject to any disclaimer, the term of this patent is extended or adjusted under 35 U.S.C. 154(b) by 134 days.

(21) Appl. No.: 14/043,388

(22) Filed: Oct. 1, 2013

(65) Prior Publication Data

US 2015/0093223 A1 Apr. 2, 2015

(51) Int. Cl.
*B65F 3/04* (2006.01)
*B65F 3/02* (2006.01)

(52) U.S. Cl.
CPC ..... *B65F 3/041* (2013.01); *B65F 2003/023* (2013.01); *B65F 2003/0276* (2013.01); *B65F 2003/0279* (2013.01)

(58) Field of Classification Search
CPC ..... B65F 2003/023; B65F 2003/0266; B65F 2003/0269; B65F 2003/0073; B65F 2003/0276; B65F 2003/0279; B65F 2003/0283; B65F 3/04; B65F 3/046
See application file for complete search history.

(56) References Cited

U.S. PATENT DOCUMENTS 3,136,436 A 6/1964 Erlinder et al.
3,174,636 A 3/1965 Dempster et al.
3,822,802 A * 7/1974 Evans, Jr. ..... 414/501
4,219,298 A 8/1980 Stragier et al.
4,313,707 A 2/1982 Bingman et al.
4,597,710 A * 7/1986 Kovats ..... 414/409
4,669,940 A 6/1987 Englehardt et al.
5,007,786 A 4/1991 Bingman
5,026,104 A * 6/1991 Pickrell ..... 294/86.4
5,049,026 A 9/1991 Bingman et al.
5,092,731 A 3/1992 Jones et al.
RE34,292 E 6/1993 Bingman et al.
5,230,393 A 7/1993 Mezey
5,702,225 A 12/1997 Ghibaudo
6,491,489 B1 12/2002 Stragier
6,494,665 B1 * 12/2002 Bingman ..... 414/409
6,722,839 B2 4/2004 Bingman
7,210,890 B2 5/2007 Curotto et
7,390,159 B2 6/2008 Rimsa et al.
7,553,121 B2 6/2009 Curotto et al.
7,559,734 B2 7/2009 Khan et al.
7,559,735 B2 * 7/2009 Pruteanu et al. ..... 414/409
8,092,141 B2 1/2012 Curotto et al.
8,496,427 B2 7/2013 Curotto et al.
8,550,764 B2 10/2013 Rowland et al.
2002/0154973 A1 10/2002 Bradshaw et al.
2005/0111942 A1 5/2005 Rimsa et al.
2006/0280582 A1 * 12/2006 Kouri ..... 414/408
2010/0322749 A1 12/2010 Rowland et al.
2012/0273498 A1 * 11/2012 Curotto ..... 220/495.06

FOREIGN PATENT DOCUMENTS

EP 0 638 491 2/1995
EP 0638491 A1 * 2/1995 ..... B65F 3/08
WO WO96/33112 10/1996

* cited by examiner

*Primary Examiner* — Kaitlin Joerger
(74) *Attorney, Agent, or Firm* — Harness, Dickey & Pierce, P.L.C.

(57) ABSTRACT

A vertically adjustable collection arm assembly for picking up refuse cans has an arm mechanism to pick up the cans. A lift mechanism raises and lowers the arm mechanism. The lift mechanism is coupled with the arm mechanism and a structure. The lift provides vertical movement to lift and lower the arm mechanism with respect to the structure.

14 Claims, 5 Drawing Sheets

VERTICAL ADJUSTABLE SIDE ARM OF A REFUSE VEHICLE

FIELD

The present disclosure relates to front loading refuse vehicles with intermediate containers and, more particularly, to a vertically adjustable side arm.

BACKGROUND

Various types of intermediate cans or containers on refuse vehicles exist in the art. U.S. Pat. Nos. 8,092,141; 7,553,121; 7,210,890 and 8,496,427 are examples of such intermediate containers. These types of containers are known in the art as "Curotto Cans". Generally, Curotto cans include a side loading robotic arm at the rear or front of the container. This arm is movable in and out and is secured on the outer wall of the container. While these types of sliding side loading arms on intermediate containers work satisfactorily, designers strive to improve the art.

Accordingly, the present disclosure provides a side loading arm for an intermediate container or the bumper of a vehicle that moves vertically. The arm may be mounted on any side of the intermediate container, but preferably on the front or back wall.

SUMMARY

Accordingly to a first aspect of the disclosure, a vertical adjustment arm mounted to a structure for picking up refuse cans comprises an arm mechanism to pick up the refuse can. A housing is coupled with the arm mechanism. A lift mechanism raises and lowers the arm mechanism. The lift mechanism is coupled with the housing. The lift mechanism is secured to the structure to enable vertical movement of the arm mechanism with respect to the structure. The structure may be a bumper of a refuse vehicle or a wall of an intermediate container. The lift mechanism generally is a hydraulic cylinder; however, it could be a manual adjustment type. The arm mechanism includes a grabber to grasp refuse cans. A pair of guides is on the structure to enhance the vertical movement of the arm mechanism.

According to a second aspect of the disclosure, a vertical adjustment arm for picking up refuse cans comprises an arm mechanism to pick up refuse cans. A housing is coupled with the arm mechanism. A lift mechanism raises and lowers the arm mechanism. The lift mechanism is coupled with the arm mechanism housing. The lift mechanism is adapted to be secured to a stationary member. The lift mechanism provides vertical movement of the arm mechanism. The arm mechanism may be mounted on a bumper of a refuse vehicle or an intermediate container. The lift mechanism may be a hydraulic cylinder or a manually operated mechanism. The arm mechanism includes a grabber to grasp refuse cans. A pair of guides enhances vertical movement of the arm mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
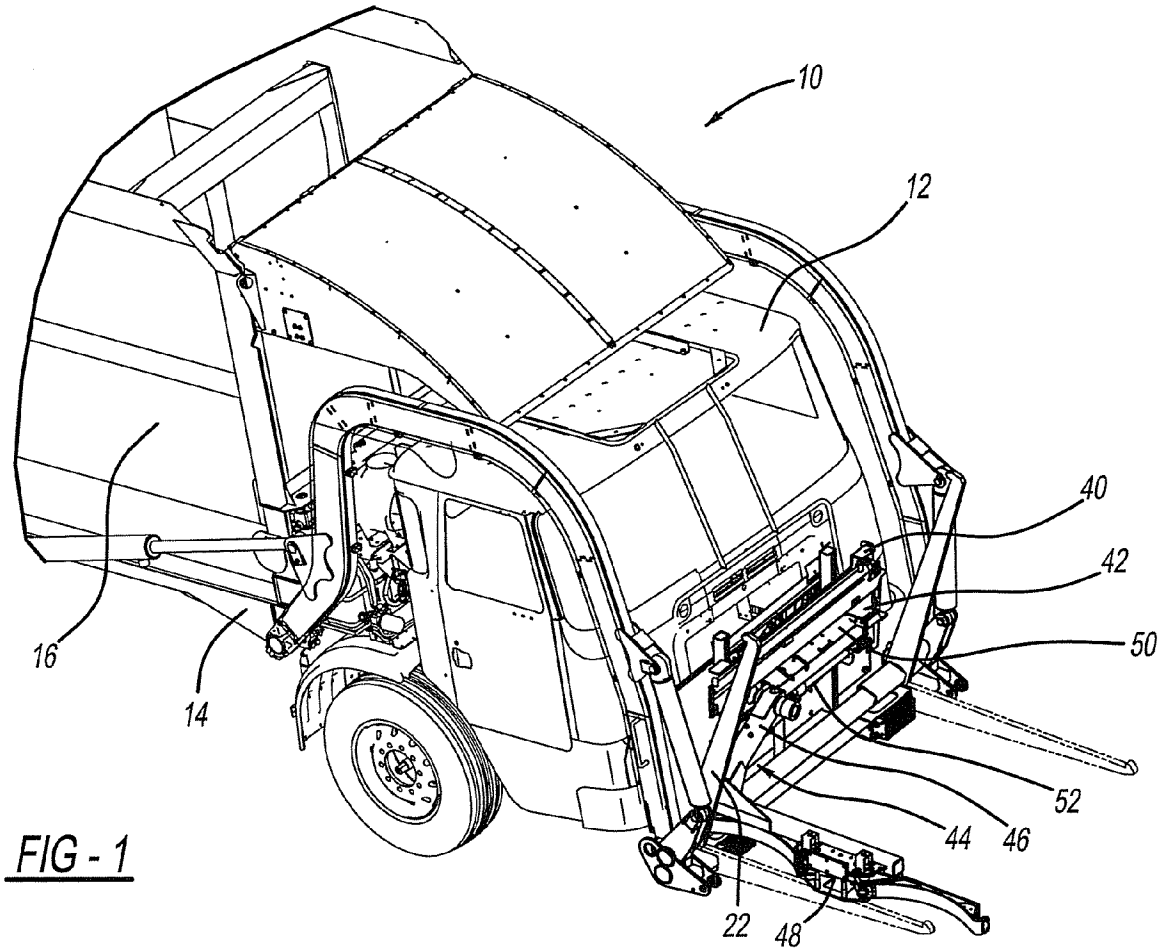
FIG. 1 is a perspective view of the side arm assembly mounted on the bumper of a vehicle.
Figure 2:
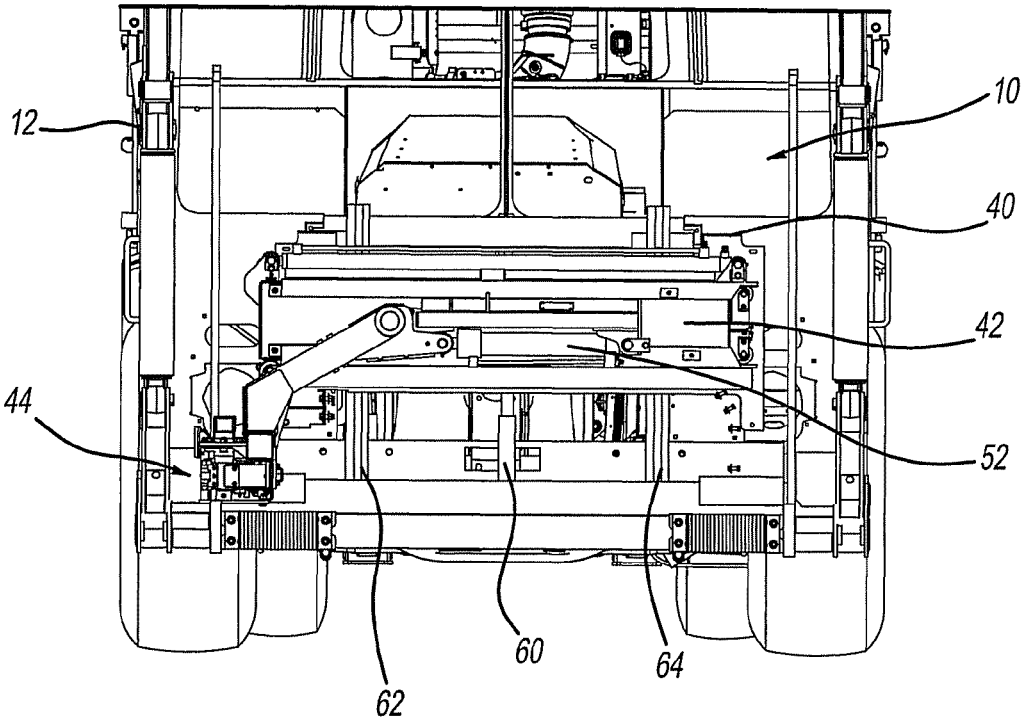
FIG. 2 is a front plan view of the side arm assembly mounted on the bumper of a vehicle like in FIG. 1.

Turning to the figures, a refuse vehicle is illustrated and designated with the reference numeral 10. The refuse vehicle 10 includes front loading arms 12 with a stationary container 14 that includes an open hopper 16 to receive refuse from an intermediate can 18. A side loading arm 20 is positioned on the bumper 22 of the vehicle 10.

The intermediate can 18 has an overall box shape with a front wall 24, a rear wall 26, sidewalls 28, 30, a bottom 32 and an open top 34. Thus, refuse can be positioned into the intermediate container through the open top 34 and remain in the intermediate container 10 until it is dumped into the hopper 16. Also, the intermediate container includes a pair of channels 36 that enable the front loading arm forks 13 to pass therethrough to enable lifting and transporting of the intermediate container 18.

The collection arm 33 assembly includes a housing 40 mounted with the bumper 22. A slide 42 is positioned within the housing 40. A hydraulic cylinder is coupled between the housing and the slide 42 to enable sliding lateral movement of the slide member 42 with respect to the housing 40. A grabber assembly 44 is secured with the slide member 42. The grabber assembly 44 includes a frame 46 with a grabber 48 attached to the frame 46. The frame 46 includes one end that is pivotally secured with a bracket 50 mounted on the slide member 42. A hydraulic cylinder 52 is mounted with the bracket 50 to pivot the frame 46 with respect to the bracket 50. Thus, the slide member 42 laterally moves the grabbing assembly 44 with respect to the vehicle 10 and the cylinder 52 pivots the frame 46 with respect to the slide 42.

A lift mechanism 60 is mounted between the housing 40 and the bumper 22. The lift mechanism 60 may be a hydraulic cylinder or the like. The lift mechanism provides for vertical movement of the housing 40 as well as the collection arm with respect to the bumper 22. Thus, this enables the collection arm to move vertically, up and down, with respect to the pavement. Thus, the collection arm is capable of picking up refuse cans positioned above or below the pavement.

Figure 7:
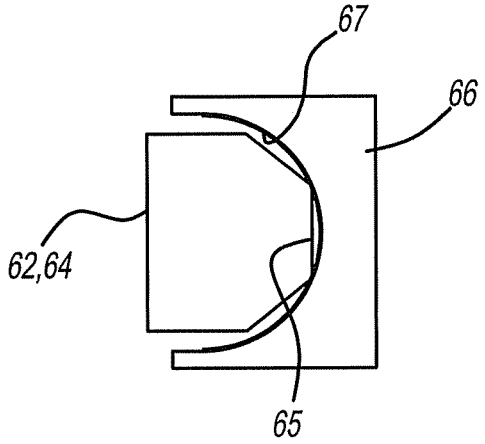
FIG. 7 is a cross-sectional view of side and block assembly.

A pair of guides 62, 64 enhances movement of the collection arm assembly housing 40 on the vehicle 10. The guides 62, 64 have a trapezoidal cross section portion as seen in FIG. 7. The housing 40 includes a pair of blocks 66, as illustrated in FIG. 7, that slide along the guides 62, 64. The blocks 66 have a cutout 67 with an overall C-shape to enable the collection arm assembly. This provides a two point contact between the block and the guide 62, 64 to prevent substantial movement of the collection arm assembly.

The lift mechanism 60 may be coupled with the vehicle's hydraulic system to drive the lift mechanism in a vertical direction while lifting and lowering the collection arm with respect to the bumper 22 of the vehicle 10. The lift mechanism 60 may be controlled within the cab of the vehicle or an exterior control may be used.

Figure 3:
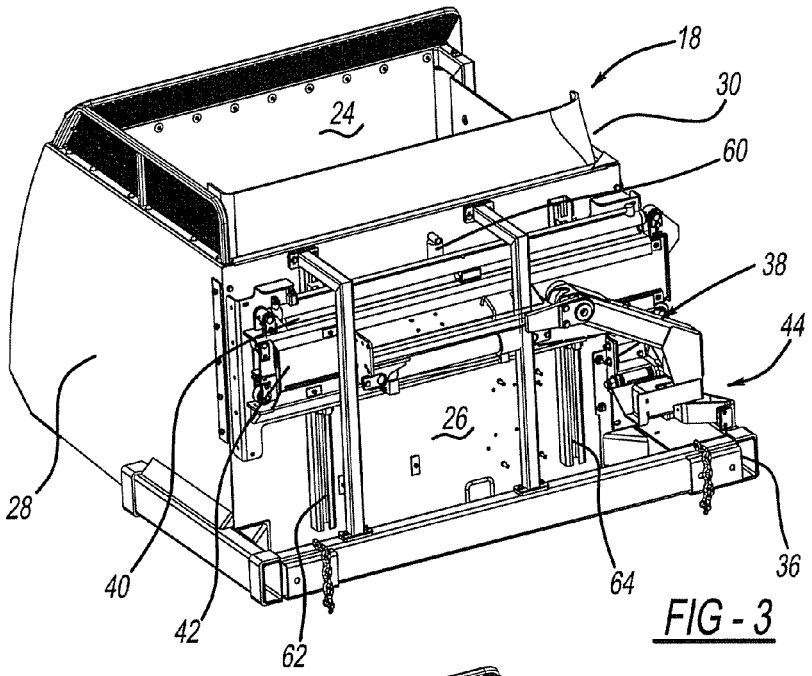
FIG. 3 is a perspective view of the side arm mounted to an intermediate container.
Figure 4:
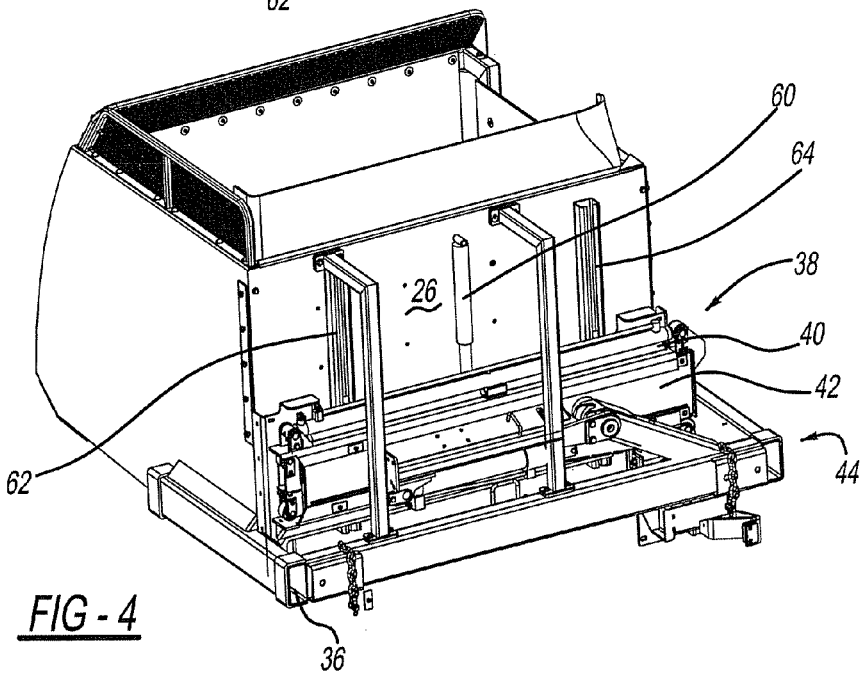
FIG. 4 is a view like FIG. 3.
Figure 5:
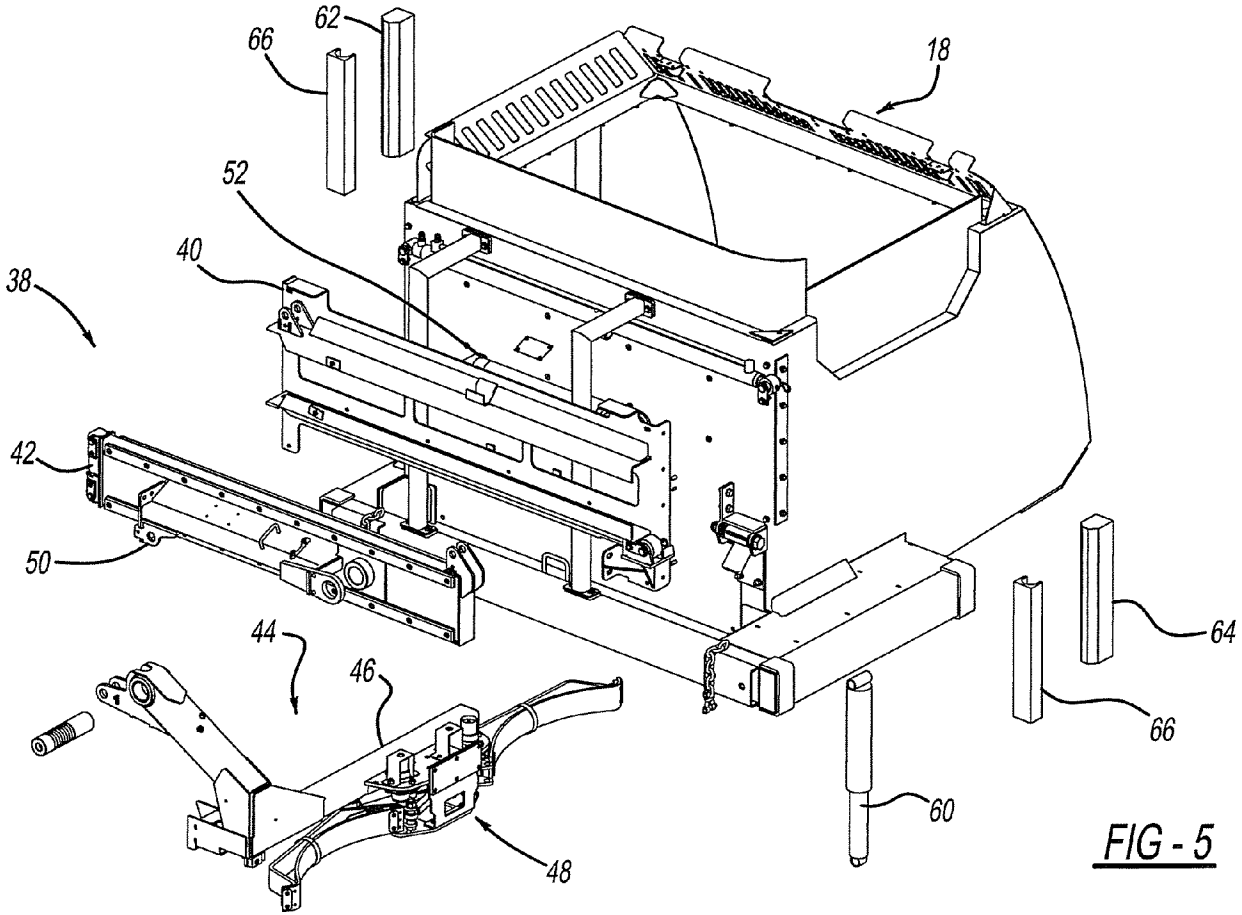
FIG. 5 is an exploded perspective view of the side arm assembly of FIG. 3.

Turning to FIGS. 3 and 5, the collection arm and lift assembly 60 is illustrated on an intermediate container 18. In FIGS. 3-5, the collection arm is illustrated on the rear wall 26 of the intermediate container 18. The collection arm is substantially the same as that previously described and thus the same numerals will be utilized.

Here, the lift mechanism 60 is secured with the rear wall 26 of the intermediate container 18. However, it should be understood that the arm could be positioned anywhere or on any side of the container at various vertical locations. One end of the lift mechanism 60 is positioned near the top of the rear wall 26. Thus, the lift mechanism 60 raises and lowers the collection arm assembly with respect to the top of the rear wall 26 of the intermediate container 18. The guides 62, 64 are positioned on the rear wall 26 of the intermediate container 18.

Figure 6:
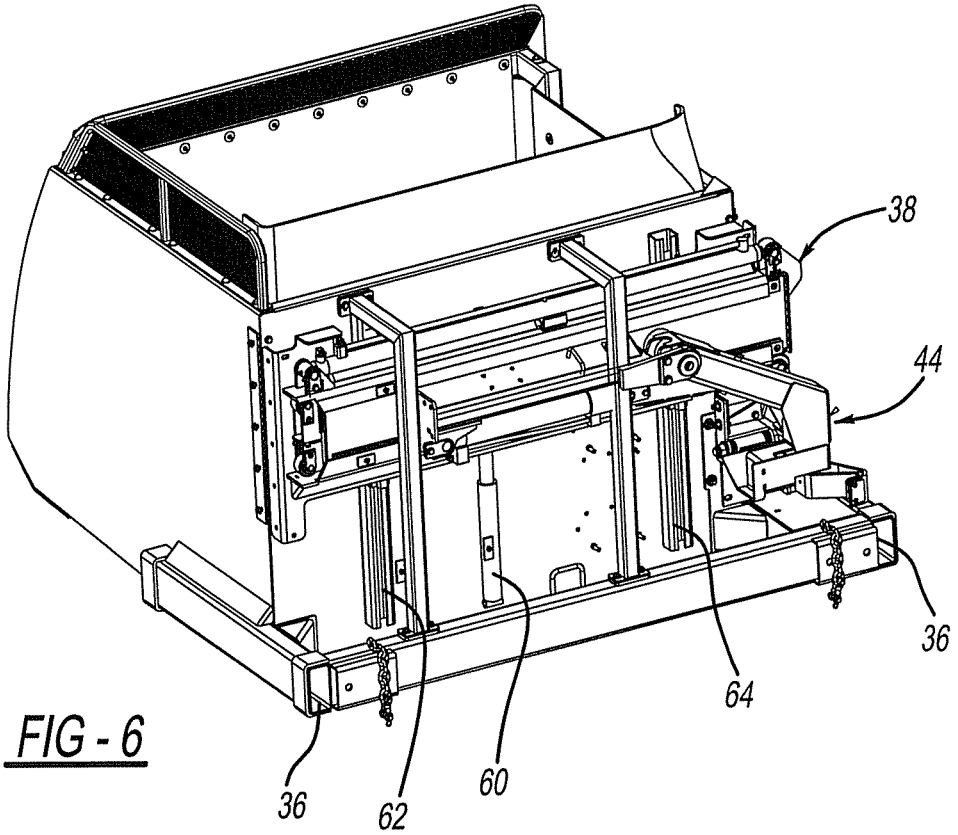
FIG. 6 is a perspective view of another embodiment of the side arm mounted on an intermediate container.

Turning to FIG. 6, an additional embodiment is illustrated. In FIG. 6, the collection arm assembly is the same as that illustrated in FIGS. 4 and 5; however, the lift mechanism 60 has been moved so that it secures near the bottom of the rear wall. Thus, the lift mechanism 60 raises and lowers the arm collection assembly with respect to the bottom of the rear wall 26 of the intermediate container 18.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vertically adjustable collection arm assembly mounted to a structure for picking up refuse cans comprising:

an arm mechanism for picking up a refuse can, a housing coupled with the arm mechanism;

the arm mechanism being translatable within the housing to extend and retract for picking up the refuse cans; and a lift mechanism for raising and lowering the arm mechanism, the lift mechanism coupled with the housing, the lift mechanism is directly mounted to a vertical surface of the structure to enable vertical movement of the arm mechanism with respect to the structure.

2. The vertically adjustable arm of claim 1, wherein the structure is a bumper of a refuse vehicle.

3. The vertically adjustable arm of claim 1, wherein the structure is an intermediate container.

4. The vertically adjustable arm of claim 1, wherein the lift mechanism is a hydraulic cylinder.

5. The vertically adjustable arm of claim 1, wherein the arm mechanism includes a grabber for grasping refuse cans.

6. The vertically adjustable arm of claim 1, wherein a pair of guides are on the structure to enhance the vertical movement of the arm mechanism.

7. A vertically adjustable collection arm assembly mounted on a free standing intermediate container for picking up refuse cans comprising:

an arm mechanism for picking up a refuse can, a housing coupled with the arm mechanism;

the arm mechanism being translatable within the housing to extend and retract for picking up the refuse cans; and a lift mechanism for raising and lowering the arm mechanism, the lift mechanism coupled with the housing, the lift mechanism is directly mounted to the free standing intermediate container to enable vertical movement of the arm mechanism with respect to the free standing intermediate container.

8. The vertically adjustable collection arm of claim 7, wherein the lift mechanism is a hydraulic cylinder.

9. The vertically adjustable collection arm of claim 7, wherein the arm mechanism includes a grabber for grasping refuse cans.

10. The vertically adjustable collection arm of claim 7, wherein a pair of guides enhance the vertical movement of the arm mechanism.

11. A vertically adjustable collection arm assembly mounted to a refuse vehicle for picking up refuse cans comprising:

the refuse vehicle including a pair of front loading arms and a container;

an arm mechanism for picking up a refuse cane, a housing coupled with the arm mechanism;

the arm mechanism being translatable within the housing to extend and retract for picking up the refuse cans; and a lift mechanism for raising and lowering the arm mechanism, the lift mechanism coupled with the housing, the lift mechanism and housing positioned between the pair of front loading arms, the lift mechanism is directly mounted to the refuse vehicle to enable vertical movement of the arm mechanism with respect to the refuse vehicle.

12. The vertically adjustable collection arm of claim 11, wherein the lift mechanism is a hydraulic cylinder.

13. The vertically adjustable collection arm of claim 11, wherein the arm mechanism includes a grabber for grasping refuse cans.

14. The vertically adjustable collection arm of claim 11, wherein a pair of guides enhance the vertical movement of the arm mechanism.

* * * * *